United States Patent [19]

Kanno

[11] Patent Number: 4,462,373

[45] Date of Patent: Jul. 31, 1984

[54] AIR-TO-FUEL RATIO CONTROL METHOD AND APPARATUS

[75] Inventor: Yoshiaki Kanno, Hyogo, Japan

[73] Assignee: Mitsubishi Denki Kabushiki Kaisha, Tokyo, Japan

[21] Appl. No.: 407,363

[22] Filed: Aug. 11, 1982

[30] Foreign Application Priority Data

Aug. 12, 1981 [JP] Japan ..... 56-127494

[51] Int. Cl.[3] ..... F02D 5/00

[52] U.S. Cl. ..... 123/489; 123/440; 123/487; 123/491

[58] Field of Search ..... 123/489, 491, 487, 479, 123/478, 440, 438, 589; 60/276

[56] References Cited

U.S. PATENT DOCUMENTS

| | | | |
|---|---|---|---|
| 3,874,171 | 4/1975 | Schmidt et al. | 60/276 |
| 4,265,208 | 5/1981 | Emmert et al. | 123/440 |
| 4,269,157 | 5/1981 | Fujishiro | 123/478 |
| 4,321,903 | 3/1982 | Kondo et al. | 123/489 |
| 4,324,218 | 4/1982 | Hattori et al. | 123/440 |

*Primary Examiner*—Andrew M. Dolinar
*Attorney, Agent, or Firm*—Sughrue, Mion, Zinn, Macpeak, and Seas

[57] ABSTRACT

A method and apparatus for controlling an air-to-fuel ratio of an internal combustion engine in which the air-to-fuel ratio is maintained within a predetermined control width or range even if one or more of the sensors which detect the conditions of the engine necessary to compute the desired air-to-fuel ratio fail. An air flow sensor produces an output signal having a frequency determined in accordance with the air flow rate into the engine, an oxygen sensor disposed in the exhaust manifold of the engine detects whether the air-to-fuel is lean or rich, and a coolant temperature sensor detects the coolant temperature of the engine. Transitions in the output from the oxygen sensor are used to control the integrating direction of an integrator circuit composed of an up/down counter. A predetermined number of integration values are averaged to compute upper and lower limits of the controlled ratio. To perform the integration, a timer is started by output pulses from the air flow rate sensor after having been preset with a digital value determined in accordance with the outputs of the air flow rate sensor and the coolant sensor. Clock pulses for the timer are supplied from a frequency divider, the frequency division ratio of which is set by the integration value if the integration value falls within the control width or range, and by upper and lower limits if the integration value is outside of the control range.

16 Claims, 5 Drawing Figures

AIR-TO-FUEL RATIO CONTROL METHOD AND APPARATUS

BACKGROUND OF THE INVENTION

The present invention relates to a method for controlling the air-to-fuel ratio in an internal combustion engine in which the air-to-fuel ratio is determined from components in the exhaust gas expelled from the engine.

In the prior art, to control the air-to-fuel ratio, a method such as the following has generally been employed. An oxygen sensor is used to detect the air-to-fuel ratio from exhaust gas components of the engine. The output of the oxygen sensor is compared with a predetermined voltage. According to the result of this comparison, the integration direction of an integrator is controlled. The rate at which fuel is supplied to the internal combustion engine is then varied in proportion to the output of the integrator to control the air-to-fuel ratio.

The method described above has found wide use. However, the method is disadvantageous in that if the oxygen sensor fails or the electrical connections thereto are broken, the output signal from the oxygen sensor will no longer correspond to the desired variations of the air-to-fuel ratio. As a result, the integration function is performed only in one direction, whereupon the air-to-fuel ratio becomes extremely large or small (lean or rich) to the point that the engine may stall.

This difficulty may be overcome by limiting the width of variation (the feedback control width) of the integrator. In this case, different air-to-fuel ratios are set for different engines by an open loop technique in accordance with various parameters of the engine. However, using this technique, if the air-to-fuel ratio is on the lean side, it is considerably difficult to perform feedback control to shift the air-to-fuel ratio towards the rich side. That is, the controllability of the air-to-fuel ratio is less than desirable.

SUMMARY OF THE INVENTION

An object of this invention is thus to overcome the above-described difficulties accompanying a conventional air-to-fuel ratio controlling method.

According to the method of the invention, the output of an integrator is averaged over a predetermined number of integration results to obtain an average value, the output of the integrator is limited so as to be within a predetermined range or control width with the average value as the center, and the range of variation of an air-to-fuel ratio controlling signal is allowed to shift within a predetermined width determined according to the average value of the variations at all times.

DESCRIPTION OF THE PREFERRED EMBODIMENTS

A preferred embodiment of an air-to-fuel ratio control method of the invention will be described with reference to the accompanying drawings.

Figure 1:
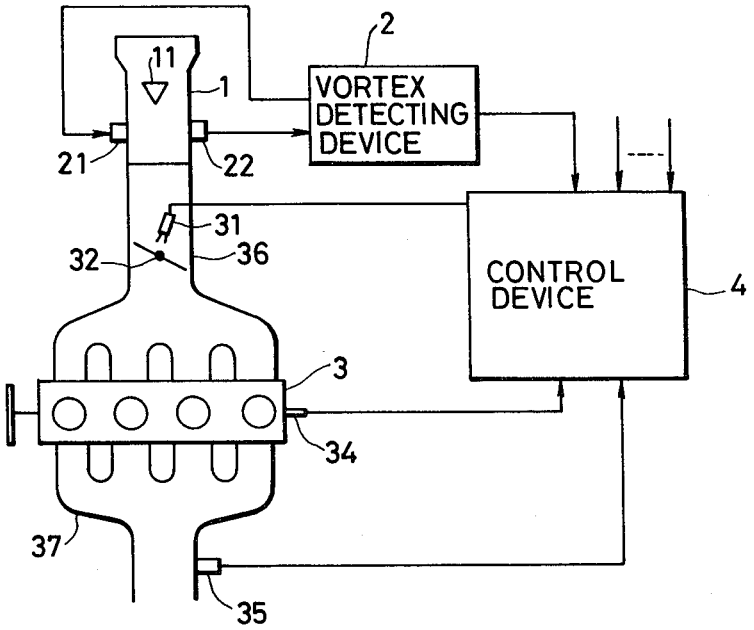
FIG. 1 is an explanatory diagram showing an air-to-fuel ratio control device of the invention.

FIG. 1 is a diagram showing the arrangement of an air-to-fuel ratio control system of the invention. In FIG. 1, reference numeral 1 designates an air flow sensor of the von Kármán vortex type through which the intake air for an internal combustion engine passes. In this sensor, vortices are created downstream of a vortex generator 11 provided in the air flow sensor 1. Ultrasonic waves produced by an ultrasonic wave generating element 21 are frequency-modulated by the presence of these vortices. The frequency-modulated ultrasonic waves are detected by an ultrasonic wave receiving element 22.

A vortex detecting device 2 outputs a signal which causes the ultrasonic wave generating element 21 to generate ultrasonic waves. Also in the device 2, the output signal from the ultrasonic wave receiving element 22 is demodulated by an FM signal demodulator to thereby obtain a pulse train having a frequency corresponding to the frequency of the vortices created downstream of the vortex generator 11. The frequency of the pulse train is proportional to the flow rate of air passing through the air sensor 1, that is, the rate at which air is sucked through the intake manifold of the internal combustion engine.

Further in FIG. 1, reference numeral 3 designates generally an internal combustion engine as may be used in an automobile for instance. The engine 3 sucks in a mixture of air flowing through an intake manifold 36 and fuel supplied through a fuel supplying valve 31 provided upstream of a throttle valve 32. The throttle valve 32 is adapted to control the flow rate of air sucked into the internal combustion engine 3. The fuel supplying valve 31 is connected to a fuel pump (not shown) and a fuel pressure regulator (not shown) which operate to maintain the difference in pressure between the intake manifold 36 and the fuel which is supplied to the fuel supplying valve 31 at a constant value.

Also in FIG. 1, reference numeral 34 designates an engine coolant temperature sensor which detects the temperature of the coolant of the internal combustion engine 3. The coolant temperature sensor 34 may be, for instance, a thermistor whose resistance increases as temperature decreases.

Reference numeral 35 designates an oxygen sensor which detects the air-to-fuel ratio from gas exhausted through an outlet manifold 37. The oxygen sensor, for instance, outputs a voltage of about 1 V when the actual air-to-fuel ratio is smaller (richer) than a predetermined fixed air-to-fuel ratio, and a voltage of about 0.1 V when the actual air-to-fuel ratio is larger (leaner) than the predetermined ratio. Reference numeral 4 designates a control device which receives signals from the vortex detecting device 2, the engine coolant temperature sensor 34, and the oxygen sensor 35 and, in response to these signals and signals representing other engine operating conditions, controls the time of opening of the fuel supplying valve 31, thereby controlling the flow rate of fuel supplied to the engine 3.

Figure 2:
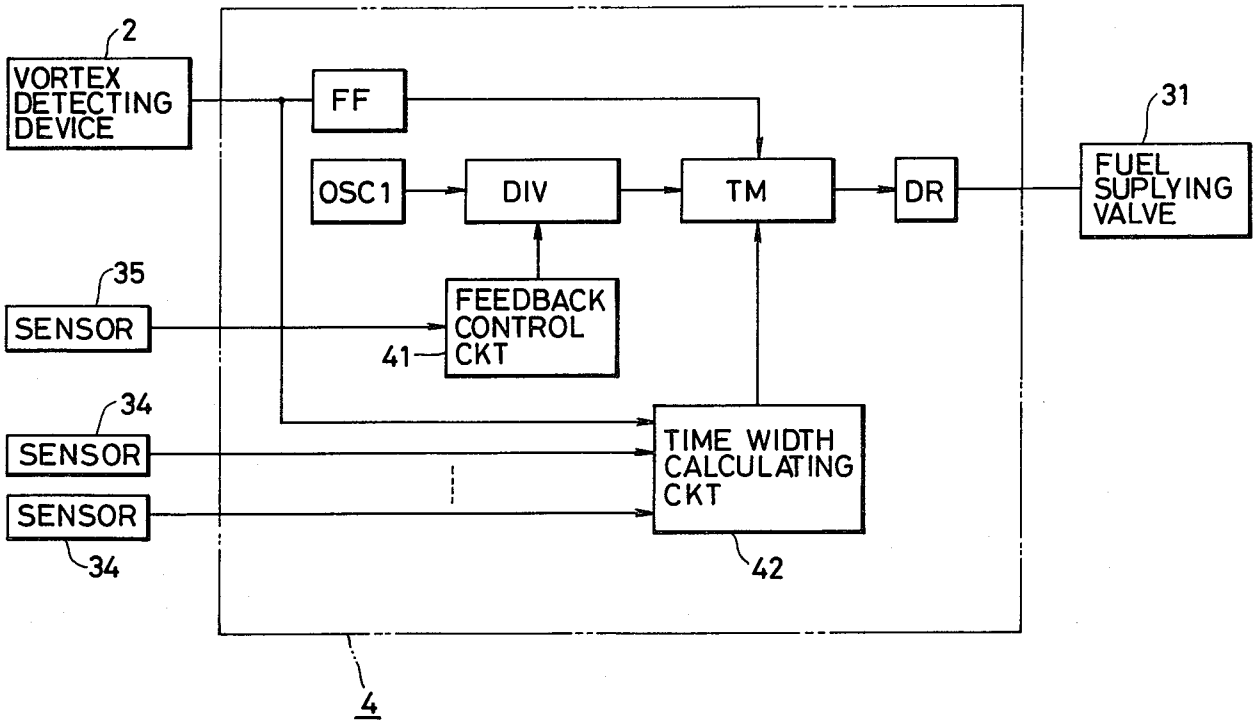
FIG. 2 is a block diagram showing the circuit arrangement of the control device of FIG. 1.

FIG. 2 is a block diagram showing the arrangement of the control device. In FIG. 2, reference numeral 42 designates a time width calculating circuit in which the time of opening of the fuel supplying valve is calculated according to the signals from the vortex detecting device 2, the engine coolant temperature sensor 34, etc. A digital value corresponding to the time thus calculated is applied to a timer TM. The output of an oscillator OSC1, after being frequency-divided by a frequency divider DIV, is applied to the clock signal input of the timer TM. The frequency division ratio of the frequency divider DIV is controlled by a feedback control circuit 41 which operates in response to the output of the oxygen sensor 35. The output of the vortex detecting circuit (air flow rate detecting circuit) is frequency divided by a factor of two by a flip-flop FF and then applied as a trigger signal to the timer TM. Upon reception of each pulse of the trigger signal, the output signal of the timer TM is raised to a high logic level "H". The output signal of the timer TM in the "H" state causes the loading of the numerical value which is then outputted by the time width calculating device 42, and subsequently the start of counting of the pulses outputted by the frequency divider DIV. When the count of the output pulses reaches the numerical value outputted by the time width calculating device, the output of the timer TM is set to the "L" state. A driver DR operates to open the fuel supplying valve 31 when the output of the timer TM is at "H" and to close the valve 31 otherwise.

The output frequency of the vortex detecting device 2 is proportional to the flow rate of air into the internal combustion engine 3. Therefore, as the flow rate of air into the engine increases, the frequency of the trigger signal pulses applied to the timer TM is increased, and accordingly the frequency of opening the fuel supplying valve 31 is increased. If the output pulse width of the timer TM is substantially constant, the engine will receive fuel at a rate which is substantially constant with respect to the flow rate of air into the engine.

The time width calculating device 42 changes the digital value outputted to the timer TM when the coolant temperature sensor 34 detects a change in the temperature of the cooling water so that, when the engine cools, the pulse width of output pulses from the timer TM is increased, and hence the amount of fuel supplied to the engine is increased.

In the feedback control device 41, the air-to-fuel ratio of the engine is determined from the density of oxygen, sensed by the oxygen sensor 35, in the exhaust gas expelled from the engine 3. In response to the output signal from the sensor 35, the period of the clock signal supplied to the timer TM is changed.

The pulse width of output pulses from the timer TM, measured from the time when the trigger signal is supplied to the timer, can be determined from $\tau \times M \times N$ where $\tau$ is the period of the output pulses from the oscillator OSC1, M is the value which is applied to the frequency divider DIV by the feedback control device 41, and N is the value which is applied to the timer TM by the time width calculating circuit 42. Thus, the pulse width is controlled in accordance with the outputs of the calculating device 42 and the oxygen sensor 35. The timer TM may be implemented, for example, with a down counter having its clock input connected to the output of the frequency divider DIV, its reset input connected to the output of the flip-flop FF, and preset inputs connected to the output lines from the time width calculating circuit 42. The zero state of the down counter is decoded to provide the output signal from the timer TM.

The frequency divider DIV is implemented with a down counter. In the frequency divider so constructed, the output pulses applied from the oscillator OSC1 are counted, and when the count value reaches zero, the output value from the feedback control device 41 is preset in the down counter whereupon the decrementing operation is started again.

Figure 3:
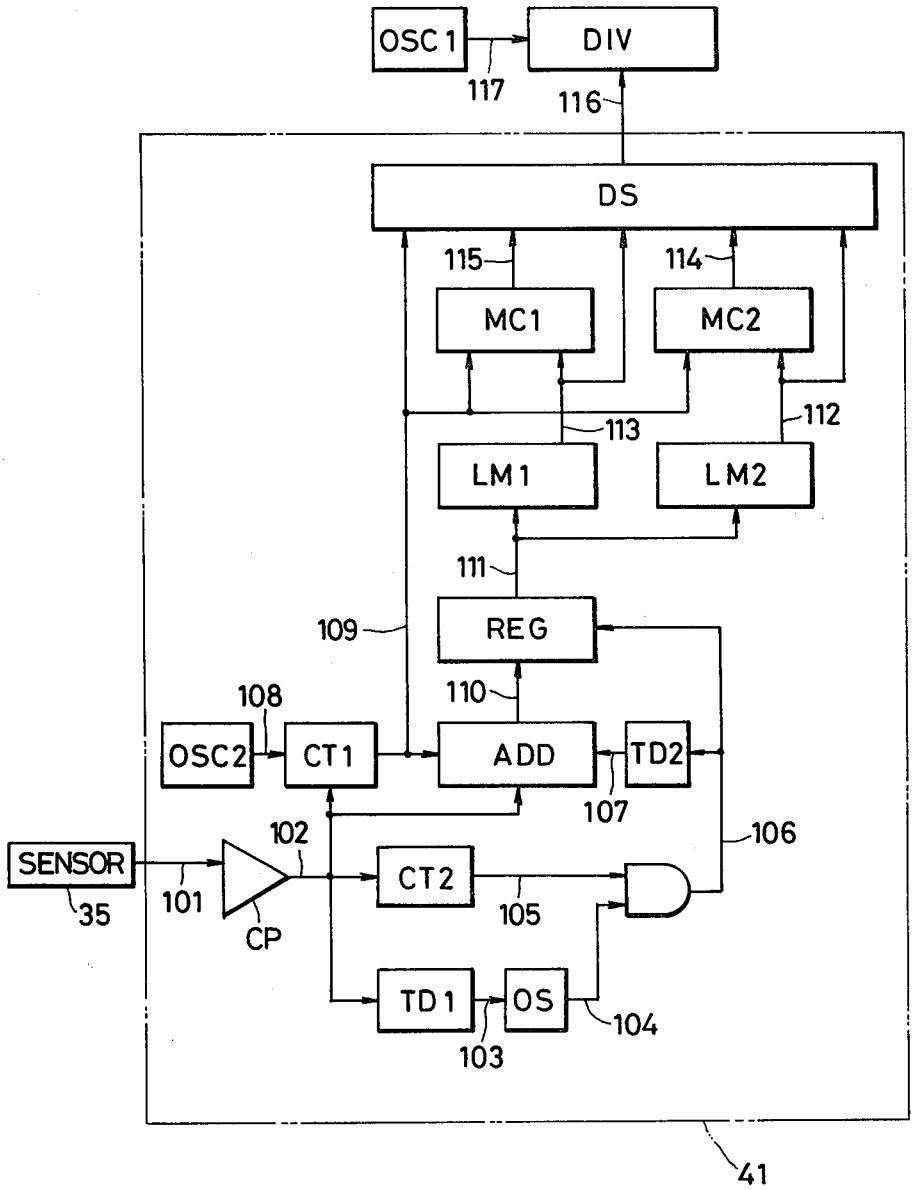
FIG. 3 is a detailed block diagram showing the circuit arrangement of a feedback control circuit used in FIG. 2.
Figure 4:
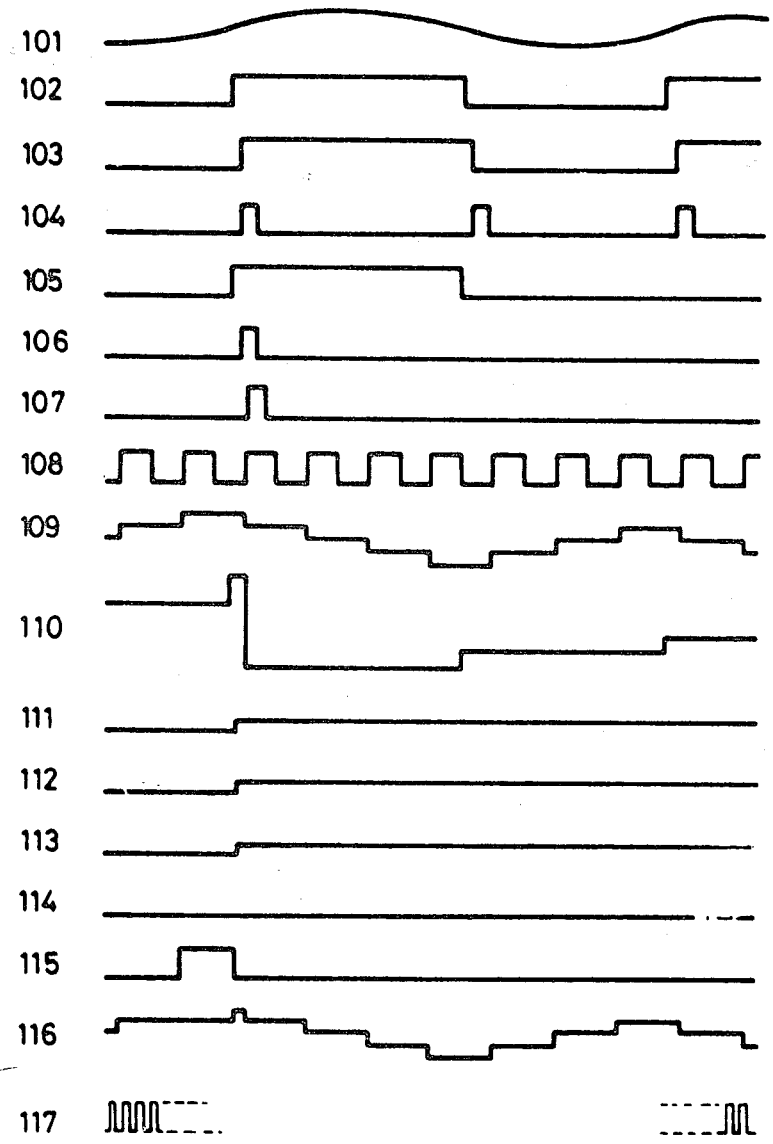
FIG. 4 is a diagram showing the waveforms of signals as indicated in FIG. 3.

FIG. 3 shows the circuit arrangement of the feedback control device 41. FIG. 4 is a diagram showing the waveforms of signals as indicated in FIG. 3. An oscillator OSC2 supplies a pulse signal 108 having a constant period to an up/down counter CT1. A comparator CP compares the voltage of the output signal 101 from the oxygen sensor 35 with a set voltage. When the output voltage is higher than 0.5 V, for instance, the comparator CP outputs an "H" signal 102, while when the voltage of the output signal from the oxygen sensor is lower than that voltage, the comparator outputs an "L" signal 102. The counter CT1, for example, can be implemented with an eight-bit up/down counter. The counter is preset to the value "128" when the internal combustion engine is stopped. If the output of the comparator is in the "H" state after the engine is started, the counter is decremented. If the output is in the "L" state after the engine is started, the counter is incremented. The stopped state of the internal combustion engine is detected, for instance, by detecting the period between ignition pulses of the engine. If the period thus detected is larger than a predetermined value, it is determined that the engine is stopped.

In FIG. 3, ADD designates a 12-bit adder which, whenever the output 102 of the comparator CP changes, accumulatively adds the count value 109 of the counter CT1 to its present content. That is, the adder adds to its present content the count value of the counter CT1 whenever the output of the comparator CP changes. CT2 designates a four-bit counter which counts the changes in output state of the comparator CP. The counter CT2 produces an output 105 when the counter CT2 has counted sixteen changes in the output state of the comparator CP.

TD1 designates a delay circuit for delaying the output 102 of the comparator CP. The output of the delay circuit TD1 triggers a monostable multivibrator OS. When the output state 103 of the delay circuit TD1 changes from "H" to "L" or from "L" to "H", the multivibrator OS outputs a pulse 104 in the "H" state having a predetermined pulse width. The output 106 of the AND gate G is then in the "H" state for the period of time during which the counter CT2 produces the output 105 and the pulse output 104 from the monostable multivibrator OS is in the "H" state, and is in the "L" state otherwise. REG designates an eight-bit register. The register REG stores the eight highest order bits of the addition result of the adder ADD at the time when output level 106 of the gate G changes from "L" to "H", that is, after the output state of the comparator CP has changed sixteen times and the adder ADD has summed the count value 109 of the counter CT1 sixteen times. Storing in the register REG the eight highest order bits 110 of the addition result of twelve bits means that the addition result is multiplied by a factor of 1/16, thus providing the average value of sixteen count values 109 outputted by the counter CT1. The output 106 of the gate G, after being delayed by a delay circuit TD2, is applied to the clear terminal of the adder ADD, so that the result of the adder ADD is zeroed after it is stored in the register.

The result 111 stored in the register REG is supplied to limiters LM1 and LM2. In the limiter LM1, a predetermined value is added to the result stored in the register REG to obtain an upper limit value 113. The upper limit value is applied to a digital comparator MC1. In the limiter LM2, a predetermined value is subtracted from the result stored in the register REG to obtain a lower limit value 112. The lower limit value is applied to a digital comparator MC1. The digital comparator MC1 compares the output 109 of the counter CT1 and the upper limit value 113. If the output of the counter CT1 is larger than the upper limit value, the comparator MC1 outputs a signal 115 at the "H" level to a data selector DS, and when the output of the counter CT1 is smaller, the comparator MC1 supplies an "L" level signal to the data selector. The digital comparator MC2 compares the output 109 of the counter CT1 and the lower limit value 112, if the output of the counter CT1 is smaller than the lower limit value, the comparator MC2 supplies a signal 114 at the "H" level to the data selector DS, and when the output of the counter CT1 is larger, the comparator supplies an "L" level signal to the data selector DS.

The data selector DS receives the outputs of the counter CT1, the limiter LM1 and the limiter LM2, and outputs one of these three signals in accordance with the states of the output signals from the digital comparators MC1 and MC2. Specifically, the data selector DS selects the output of the limiter LM1 when the output of the digital comparator MC1 is in the "H" state, the data selector DS selects the output of the limiter LM2 when the output of the digital comparator MC2 is in the "H" state, and the data selector DS selects the output of the counter CT1 when the outputs of both of the digital comparators MC1 and MC2 are in the "L" state. The selected output is applied to the frequency divider DIV.

The output 117 of the oscillator OSC1 is thus frequency-divided in a ratio set by the output 116 of the data selector DS in the frequency divider DIV. The period of the output of the frequency divider is increased as the digital value of the output signal from the data selector DS increases.

Figure 5:
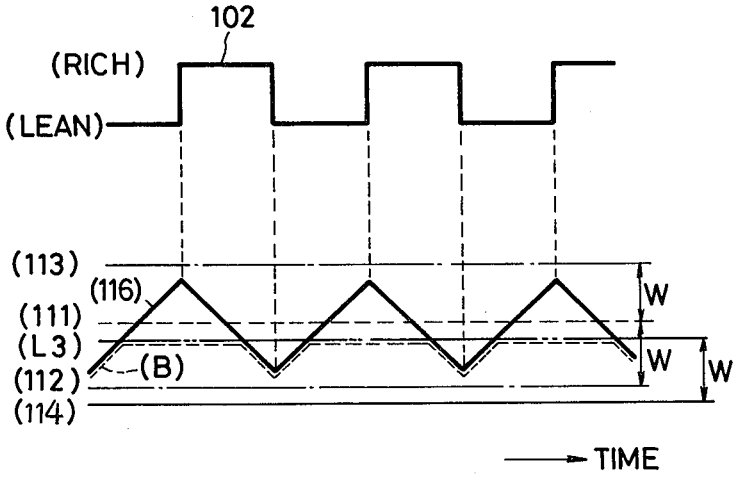
FIG. 5 is a timing chart used for a description of the operation of the control device of FIG. 2.

FIG. 5 is a timing chart illustrating the operation of the control device 4 when the output 109 of the counter CT1 is controlled. In FIG. 5, the output 102 of the comparator CP is in the "L" state when the air-to-fuel ratio of the internal combustion engine 3 is lean and is raised to "H" when the ratio is rich. Further in FIG. 5, 114 designates the initial count value of the counter CT1 when the engine 3 is stopped, and 111 designates the output value of the register REG, that is, the average value of the results of addition of the count values which are provided by the counter CT1 whenever the output state of the comparator CP is changed. The aforementioned upper limit value 113 is larger by W than the average value 111, and the lower limit value 112 is smaller by W than the average value 111. The set frequency division ratio of the frequency divider DIV changes with the output 116 of the data selector DS, which here corresponds to the output of the comparator CP, and hence the period of the output signal produced by the frequency divider DIV changes with the output 116. Accordingly, the output pulse width from the timer TM varies as indicated by the output 116. That is, when the output 102 of the comparator CP is at "L", that is, when the air-to-fuel ratio of the internal combustion engine is lean, the fuel supplying valve 31 opening time is gradually increased, and when the output 102 of the comparator CP is at "H", i.e., the air-to-fuel ratio is rich, the fuel supplying valve 31 opening time is gradually decreased. Thus, the air-to-fuel ratio of the engine 3 is controlled so that the average value of the air-to-fuel ratio is the desired predetermined air-to-fuel ratio.

If the output 102 of the comparator CP remains at "H" for some reason, the output 116 will be clamped at the lower limit value 112. That is, a lower limit of the value set in the frequency divider DIV is maintained and the opening time of the supplying valve 31 is not decreased below a time corresponding to the limit value. Accordingly, the problem of the prior art of the air-to-fuel ratio of the engine becoming abnormally lean is prevented. If, on the other hand, the output 102 of the comparator CP remains at "L", the output 116 will be clamped at the higher limit value 113 to thus prevent the air-to-fuel ratio from becoming extremely rich.

A preferred embodiment has been described with reference to a case where the air-to-fuel ratio is controlled by controlling the rate at which fuel is supplied. However, this embodiment may be modified by setting the fuel supply rate at a value richer than the above-described predetermined air-to-fuel ratio. The flow rate of air supplied downstream of the throttle valve 32 is then gradually increased when the output of the comparator CP is at "H" and gradually decreased when the output is at "L".

As is apparent from the above description, according to the invention, the air-to-fuel ratio of an internal combustion engine is controlled so as to be within a predetermined width or range which extends equally on both sides of a continuously calculated average value of an air-to-fuel ratio feedback integration value. Thus, with the invention, air-to-fuel ratio control is performed with high accuracy. Moreover, even if the integration result goes excessively in one direction due to a component defect or the like, it is clamped at a limit value. This action prevents the air-to-fuel ratio from being forced to values which would greatly adversely affect the operating performance of the engine.

What is claimed is:

1. A method for controlling an air-to-fuel ratio of an inlet mixture of an internal combustion engine, comprising the steps of:

providing a first signal representing a state of said air-to-fuel ratio;

integrating said first signal a plurality of times to obtain a corresponding plurality of values of a second signal;

averaging a predetermined number of said values of said second signal to obtain an average value centered within a control width; and providing a third signal for controlling said air-to-fuel ratio in accordance with said second signal and said control width, said third signal corresponding to said second signal limited in accordance with said control width.

2. The method of claim 1, wherein said first signal is a binary signal representing whether said air-to-fuel ratio is lean or rich.

3. The method of claim 2, wherein said step of integrating said first signal comprises providing a count starting at transitions of said first signal.

4. The method of claim 3, wherein said step of averaging said predetermined number of said values of said second signal comprises:

accumulatively adding said value of said second signal;

counting transitions in said first signal; and when the count of said transitions in said first signal reaches a predetermined count, storing a then-present accumulative sum.

5. The method of claim 4, wherein said step of providing said third signal comprises:

subtracting a predetermined constant value from a predetermined number of highest order bits of the stored accumulative sum to provide a lower limit of said control width;

adding said predetermined constant value to said predetermined number of highest order bits of said stored accumulative sum to provide an upper limit of said control width; and providing as said third signal (1) said second signal if said second signal has a value between said upper and lower limits, (2) said lower limit if said second signal has a value below said lower limit, and (3) said upper limit if said second signal has a value above said upper limit.

6. A method for controlling an air-to-fuel ratio of an internal combustion engine, comprising the steps of:

providing a first pulse signal having a frequency determined in accordance with a flow rate of air into said engine;

providing a second signal having a first state indicative of said air-to-fuel ratio being lean and a second state indicative of said air-to-fuel ratio being rich;

integrating said second signal a plurality of times to obtain a corresponding plurality of values of a third signal;

averaging a predetermined number of said values of said third signal to obtain an average value centered within a control width;

providing a fourth signal corresponding to said third signal limited in accordance with said control width;

providing a fifth signal indicative of a coolant temperature of said engine;

controlling a frequency of a pulse output from a frequency divider with said fourth signal;

resetting a timer with said first signal, clocking said timer with said output of said frequency divider, and presetting said timer with a value determined in accordance with said first and said fifth signals.

7. The method of claim 6, wherein said step of integrating said second signal comprises providing a count starting at transitions of said second signal.

8. The method of claim 7, wherein said step of averaging said predetermined number of said values of said third signal comprises:

accumulatively adding said values of said third signal;

counting transitions in said second signal; and when the count of said transitions in said second signal reaches a predetermined count, storing a then-present accumulative sum.

9. The method of claim 8, wherein said step of providing said fourth signal comprises:

subtracting a predetermined constant value from a predetermined number of highest order bits of the stored accumulative sum to provide a lower limit of said control width;

adding said predetermined constant value to said predetermined number of highest order bits of said stored accumulative sum to provide an upper limit of said control width; and providing as said fourth signal (1) said third signal if said third signal has a value between said upper and lower limits, (2) said lower limit if said third signal has a value below said lower limit, and (3) said upper limit if said third signal has a value above said upper limit.

10. An apparatus for controlling an air-to-fuel ratio of inlet mixture of an internal combustion engine, comprising:

means for providing a first signal representing a state of said air-to-fuel ratio;

means for integrating said first signal a plurality of times to obtain a corresponding plurality of values of a second signal;

means for averaging a predetermined number of said values of said second signal to obtain an average value centered within a control width; and means for providing a third signal for controlling said air-to-fuel ratio in accordance with said second signal and said control width, said third signal corresponding to said second signal limited in accordance with said control width.

11. The apparatus of claim 10, wherein said means for providing said first signal comprises means for sensing an exhaust gas expelled from said internal combustion engine and for providing said first signal in a first state when components in said exhaust gas are indicative that said air-to-fuel ratio is lean and in a second state when said components in said exhaust gas are indicative that said air-to-fuel ratio is rich.

12. The apparatus of claim 11, wherein said means for integrating said first signal comprises counter means, and means for starting said counter means at transitions of said first signal.

13. The apparatus of claim 12, wherein said means for averaging said predetermined number of said values of said second signal comprises:

an accumulator for accumulatively adding said values of said second signal;

counter means for counting transitions in said first signal; and means for storing a then-present accumulative sum in said accumulator means when said counter means reaches a predetermined count.

14. The apparatus of claim 13, wherein said means for providing said third signal comprises:

means for subtracting a predetermined constant value from a predetermined number of highest order bits of said storing means to provide a lower limit of said control width;

means for adding said predetermined constant value to said predetermined number of highest order bits from said storing means to provide an upper limit of said control width; and selector means for providing as said third signal (1) said second signal if said second signal has a value between said upper and lower limits, (2) said lower limit if said second signal has a value below said lower limit, and (3) said upper limit if said second signal has a value above said upper limit.

15. An apparatus for controlling an air-to-fuel ratio of an inlet mixture of an internal combustion engine, comprising:

means for detecting a flow rate of air into an internal combustion engine, said detecting means producing a first signal having a frequency determined in accordance with said flow rate of air;

an oxygen sensor means disposed in a path of exhaust gases expelled from said engine;

feedback control circuit means receiving an output signal from said oxygen sensor means, said feedback control circuit comprising comparing means for comparing said output signal from said oxygen sensor means with a fixed value to produce a signal having a first state when said air-to-fuel mixture is lean and a second state when said air-to-fuel mixture is rich, first counting means for starting a count at transitions in said signal produced by said comparing means between said first and second state, means for averaging a predetermined number of counts produced by said counting means immediately before transitions in said signal produced by said comparing means, means for setting a control range in accordance with the average, and means for providing said output signal from said feedback control circuit means as said count from said counting means limited by said control range;

means for sensing a coolant temperature of said engine;

means for calculating a digital value representing a time width in accordance with outputs of said air flow rate detecting means and said means for sensing a coolant temperature;

an oscillator and a frequency divider having an input connected to an output of said oscillator, a frequency division ratio setting input of said frequency divider being connected to receive said output from said feedback control circuit means;

a timer having a clock input connected to an output of said frequency divider, a trigger input connected to an output of said detecting means, and a preset input connected to receive said digital value; and means for opening and closing a fuel flow valve for supplying fuel to said engine in accordance with an output of said timer.

16. The apparatus of claim 15, wherein said comparing means comprises:

a comparator receiving said output signal from said oxygen sensor means for comparing said output from said oxygen sensor means with a fixed value; and wherein said feedback control circuit means further comprises:

a second oscillator;

an up/down second counter means having a clock input connected to an output of said second oscillator and an up/down control input connected to an output of said comparator;

a third counter means having a trigger input connected to said output of said comparator, an output of said third counter means being in a "H" state when said third counter means reaches a predetermined count;

a first delay circuit having an input connected to an output of said comparator;

a monostable multivibrator having an input connected to an output of said first delay circuit;

and AND gate having one input connected to an output of said third counter means and a second input coupled to an output of said monostable multivibrator;

a second delay circuit having an input connected to an output of said AND gate;

an accumulator having an add input connected to an output of said second counter means, a clock input connected to the output of said comparator, and a reset input connected to an output of said second delay circuit;

a register having a data input connected to an output of said accumulator and a clock input connected to said output of said AND gate;

a subtractor for substracting a predetermined fixed value from an output from said register to obtain a lower limit value;

an adder for adding said predetermined fixed value to said output from said register to obtain an upper limit value;

a first digital comparator for comparing said output from said second counter means with said upper limit value;

a second digital comparator for comparing said output from said second counter means with said lower limit value;

a multiplexer for outputting a selected one of said output from said second counter means, said upper limit value and said lower limit value in accordance with outputs of said first and second digital comparators wherein said output from said second counter means is selected when said output from said second counter means is between said upper and lower limit values, said lower limit value is selected when said output from said second counter means is below said lower limit value, and said upper limit value is selected when said output from said second counter means is above said upper limit value, the output of said multiplexer being connected to said frequency division ratio setting input of said frequency divider.

* * * * *